US007331510B1

(12) United States Patent
Brown

(10) Patent No.: US 7,331,510 B1
(45) Date of Patent: Feb. 19, 2008

(54) MAIL INDICATION APPARATUS

(75) Inventor: Lawrence K. Brown, 903 Musteen Rd., Springdale, AR (US) 72762

(73) Assignee: Lawrence K. Brown, Springdale, AR (US)

( * ) Notice: Subject to any disclaimer, the term of this patent is extended or adjusted under 35 U.S.C. 154(b) by 0 days.

(21) Appl. No.: 11/639,767

(22) Filed: Dec. 15, 2006

Related U.S. Application Data

(60) Provisional application No. 60/824,358, filed on Sep. 1, 2006.

(51) Int. Cl.
*A47G 29/12* (2006.01)

(52) U.S. Cl. ..... 232/35

(58) Field of Classification Search ..... 232/35; D99/29–32, 43

See application file for complete search history.

(56) References Cited

U.S. PATENT DOCUMENTS

| | | | | | |
|---|---|---|---|---|---|
| 627,635 | A | | 6/1899 | Bates | |
| 2,609,787 | A | * | 9/1952 | Lawson | 232/35 |
| 2,707,075 | A | * | 4/1955 | Van Duzer | 232/35 |
| 3,426,966 | A | * | 2/1969 | Lay | 232/35 |
| 3,547,070 | A | * | 12/1970 | Schuh | 232/35 |
| 3,589,329 | A | | 6/1971 | Schuh | 116/132 |
| 3,648,924 | A | | 3/1972 | Burns | 232/35 |
| 4,005,812 | A | | 2/1977 | Doyle et al. | 227/131 |
| D260,319 | S | * | 8/1981 | Kuntz, Jr. | D99/29 |
| 4,491,268 | A | | 1/1985 | Faulkingham | 232/35 |
| 4,821,953 | A | * | 4/1989 | Poloha | 232/35 |
| 5,076,337 | A | | 12/1991 | Reuter | 160/35 |
| D341,917 | S | * | 11/1993 | Meher | D99/29 |
| 5,284,295 | A | * | 2/1994 | Steinfeldt | 232/35 |
| D356,428 | S | * | 3/1995 | Piatkowski et al. | D99/43 |
| 5,482,206 | A | | 1/1996 | Waycasy | 232/35 |
| 5,660,327 | A | * | 8/1997 | Brinkley, Jr. | 232/35 |
| 5,964,401 | A | | 10/1999 | Thill | 232/35 |
| 6,155,482 | A | * | 12/2000 | Perry | 232/35 |
| D447,313 | S | * | 8/2001 | Murawski et al. | D99/43 |
| 6,318,629 | B1 | * | 11/2001 | Anderson | 232/35 |
| D457,706 | S | * | 5/2002 | Teichelman | D99/43 |
| 6,575,357 | B1 | | 6/2003 | Rundell | 232/35 |
| 6,659,337 | B2 | | 12/2003 | Woelfel | 232/35 |
| 7,025,250 | B2 | * | 4/2006 | Wolfe, Jr. | 232/35 |
| 7,083,080 | B2 | * | 8/2006 | McKenzie | 232/35 |
| 2005/0082358 | A1 | * | 4/2005 | McKenzie | 232/35 |
| 2006/0261142 | A1 | * | 11/2006 | McKenzie | 232/35 |

* cited by examiner

*Primary Examiner*—William L. Miller
(74) *Attorney, Agent, or Firm*—Keisling, Pieper & Scott PLC; Meredith K. Lowry

(57) ABSTRACT

The invention features a mail indication device for determining whether the daily mail postal person has deposited mail in a rural or suburban mailbox. The mailbox indicator features a signal indicator composed of a dense material, a linking tether, and an attachment assembly mounted near or to the mailbox door.

18 Claims, 4 Drawing Sheets

MAIL INDICATION APPARATUS

CROSS-REFERENCE TO RELATED APPLICATIONS

This application claims priority to and is a continuation-in-part of U.S. provisional application Ser. No. 60/824,358, filed Sep. 1, 2006.

STATEMENT REGARDING FEDERALLY SPONSORED RESEARCH OR DEVELOPMENT

Not Applicable

REFERENCE TO A MICROFICHE APPENDIX

Not Applicable

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The invention pertains to improvements in mailboxes, and more particularly to an improved mail indicator that notifies the mail recipient when the daily mail has been delivered and deposited into a mailbox.

2. Description of the Known Art

As will be appreciated by those skilled in the art, various mail or packages have been utilized to notify individuals that mail or packages have been delivered to a mail receptacle. Patents disclosing information relevant to alter devices include U.S. Pat. No. 627,635, issued to Bates on Jun. 27, 1899; U.S. Pat. No. 3,648,924, issued to Burns on Mar. 14, 1972; U.S. Pat. No. 3,589,329, issued to Schuh on Jun. 29, 1971; U.S. Pat. No. 4,005,812, issued to Malik on Feb. 1, 1977; U.S. Pat. No. 4,491,268, issued to Faulkingham on Jan. 1, 1985; U.S. Pat. No. 5,076,337, issued to Reuter on Dec. 31, 1991; U.S. Pat. No. 5,482,206, issued to Waycasy on Jan. 9, 1996; U.S. Pat. No. 5,964,401, issued to Thill on Oct. 15, 1999; U.S. Pat. No. 6,575,357, issued to Rundell on Jun. 10, 2003; and U.S. Pat. No. 6,659,337, issued to Woelfel on Dec. 9, 2003.

U.S. Pat. No. 627,635 issued to Bates on Jun. 27, 1899 entitled Postal Box Signal, teaches a mailbox having one or more signals connected with the box and a means for displaying the signal by the act of introducing postal matter into the box, so that it can be seen from a distance whether there is anything in the box to be collected, and in the same manner a signal is displayed to indicate to those using the box whether any mail-matter has been placed in the box for them by the carrier. However the flag system as described may cause confusion over the meaning of the flag signals. A viewer must still determine, if one flag is standing, if mail has been delivered by a postal service person or remains to be retrieved. The invention differentiates the signals by color, but at a distance, such distinguishing features can be difficult to discern. In addition, the device utilizes a complicated lever system which impairs to ease of installation within existing mail boxes.

U.S. Pat. No. 3,648,924 issued to Burns, on Mar. 14, 1972, entitled Mailbox Signal, teaches a signal device for a mailbox including a rod pivotally mounted to the mailbox at one end and supported at its forward end portion by the mailbox door in closed position, a visual signal element supported on the rod and adapted to be rotated by cooperating cam means, when the door is opened, to a depending position more visible to an observer to the rear of the mailbox. The signal device indicates the delivery of mail by falling to the depending position by rotating downwardly about a journal pin when the mailbox door is opened. However, the signal flag placed along the pivoting rod is not always visible from a distance as its connection to the rod allows the signal flag to rotate about the pivoting rod to an obscuring orientation.

U.S. Pat. No. 3,589,329 issued to Schuh on Jun. 29, 1971 entitled Signal for Mailboxes, teaches a signal attachment for a mailbox having a hinged door, comprising a lever arm adapted to be pivotally mounted at one end to the base portion of a standard type mailbox and carrying at its other end an angularly bent signal plate, in combination with a chain connected to the mailbox door at a position offset from the door hinge axis. The signal arm is adapted to be manually set in inconspicuous position alongside the base of the mailbox, and the parts are so arranged that when the mailman opens the door to deposit mail in the box, the signal arm is pulled upwardly into an upstanding attitude, whereby the signal plate portion thereof is erected into prominently displayed position. The device does not contemplate the possibility of linkage entanglement, kinking, and linkage failure of the chaining mechanism, all of which would lead to failure of the device.

U.S. Pat. No. 4,005,812, issued to Malik on Feb. 1, 1977 entitled Mailbox Having Dual Access Closures and Signal Means teaches dual-door mail box having a hinged closure which operates a signal device which is pivoted on the side of the mailbox so as to be elevated by the opening of the entry or deposit end of the box and to be lowered upon the opening of the exit or removal end of the mailbox. The entry closure operates a spring mounted rod to lift the signal device and the exit closure operates a small chain to drop the signal device back to its normal lowered position. The device does not contemplate the possibility of linkage entanglement, kinking, and linkage failure of the chaining mechanism, all of which would lead to failure of the device. Further, the device utilizes a dual-door mail box, not commonly used.

U.S. Pat. No. 4,491,268 issued to Faulkingham on Jan. 1, 1985 entitled Mailbox Delivery Signal Device teaches a rural mailbox signaling device actuated by opening of the mailbox door. A brightly colored signal rod is pivotally mounted along the top surface of the mailbox and biased in an upright position by a spring. A locking pin is pivoted at the distal end of the signal rod and is swung to a right angle position when setting the device. The door is closed and the signal rod forced against the spring to a horizontal position. The locking pin is swung to a coaxial extended position engaging a hook member attached to the door latch which holds the signal rod horizontal. When the mailman opens the door to deposit mail, the signal rod is released and flips to the upright position. The device is limited in its teachings as the signal rod extends vertically only when deployed, providing a limited surface facet for viewing by a mail recipient.

U.S. Pat. No. 5,076,337 issued to Reuter on Dec. 31, 1991 for a Mail Alert for Mailbox teaches a simplified attachment for a mailbox which alerts the mailbox addressee that mail has been delivered. The attachment includes a signal flag mounted on a spring activated spool rotatably secured within a housing affixed to the side of the mailbox. When the mailbox door is closed, the upper end of the signal flag is held under tension in a horizontal position by a keeper mounted on the door of the mailbox. When the mailbox door is opened, the signal flag is released from its horizontal position and, powered by the spring, rises to a vertical position above the mailbox to alert the addressee that the mail has arrived. This device is limited in its efficiency as an alter system as it can be confused with the pop-up flag for posted mail. Additionally, the device requires a bolt mounting for both housing and pole keeper of the signed device. The mounting of the assembly affects the integrity of the mail box by receptacle.

U.S. Pat. No. 5,428,206 issued on Jan. 9, 1996 to Waycasy entitled Automatic Mail Delivery Signaling Device teaches a signaling device that is constructed and adapted for easy installation to residential street mailboxes. The unit is triggered by opening the mailbox door, yet there are no attachments, hardware, holes or connections to the mailbox door. The unit operates automatically when the mail box door is opened, yet there are no batteries, motors, springs, clips or power devices. The user sees only a plastic housing and a flag that operates as a signaling device. The device is limited in that it requires a bolt mounting for the device to the exterior of the mail box. The mounting of the device affects the integrity of the mail box receptacle and additionally requires tools for the mounting.

U.S. Pat. No. 5,964,401 issued on Oct. 15, 1999 to Thill entitled Mail Box Indicator System teaches a mail box indicator system which includes a flag post having a flag attached to the post by a removable collar. The post is further attached to an elbow member by a coil. The elbow member is attachable to wall of a mail box. The coil urges the post into a substantially vertical position. A retention assembly is provided for holding the post in a substantially horizontal orientation when in a set position. The retention assembly is attached to the door of the mail box such that the post disengages the retention assembly when the mail box door is opened. In an alternate embodiment, the mail box indicating system includes a spacer to selectively position the post retention assembly in spaced relationship to the mail box door such that a mail box protrusion proximate the mail box door does not interfere with engagement of the post to the post retention assembly. The elbow member is attachable to the mail box using a bolt and nut holding a pair of rubber washers around a wall of the mail box. Preferably, a pair of metal washers are positioned around the rubber washers. This device is limited in its efficiency as an alert system as it can be confused with the pop-up flag for posted mail. Additionally, the device requires a bolt mounting at the signal device. The mounting of the assembly affects the integrity of the mail box receptacle and additionally requires tools for the mounting.

U.S. Pat. No. 6,575,357 issued on Jun. 10, 2003 for Rundell entitled Rural Mailbox Flags teaches the rural mailbox having a rigid flag that is raised by a Post Office patron to indicate that there is outgoing mail in the mailbox. The mail carrier lowers the rigid flag when outgoing mail is removed from the mailbox. Opening the mailbox lid to place incoming mail in the box releases a flexible flag pole to raise a flag that indicates the mailbox has been serviced by the mail carrier. Following removal of incoming mail from the mailbox, the mailbox lid is closed and the flag shaft tip is inserted into the flag shaft tip holder plate to indicate any incoming mail in the mailbox has been removed. This device is limited in its efficiency as an alert system as it can be confused with the pop-up flag for posted mail. Additionally, the device requires a bolt mounting at the signal device. The mounting of the assembly affects the integrity of the mail box receptacle and additionally requires tools for the mounting.

U.S. Pat. No. 6,659,337 issued to Woelfel on Dec. 9, 2003 entitled Universal Mailbox Flip-flag Indicator teaches a universal mailbox signal device to visually indicate mail is delivered. A detachable component is comprised of a wide flag element attached to a flat resilient nylon stem. Upon installation in a mailbox, the straight stem is bent and shaped as needed to conform to one of the many mailbox configurations available. The stem can also then be twisted to adjust the flag in a desired viewable direction. The other end of the stem will slide into a channel in an adhesively mounted base-plate on the inside of the mailbox door. The stem/flag assembly may be removed when absent to prevent an activated, non-attended flag posing a possible security problem. When mail is deposited the flag flips into view and is held firmly at the pre-adjusted viewing angle by the closed door. When mail is retrieved one hand is used to tuck in the flag and close the mailbox door. A detachable flag is disposed in the mailbox door. The detachable flag flips into view, when mail is delivered. However, the stiff, resilient stem utilized to maintain the flag in the upright position requires agile hands to reposition and refold the flag.

Some of the many drawbacks of mail indicators discussed above include complexity of the signal flag, interference for the mail postal person, mechanical unreliability of the signal flag, need for complex installation, loss of weather integrity of the mail box and signal flag positioning which limits a viewer's ability to identify when the signal flag has been deployed.

It is evident from the past applications that an improved mail indication device for a mail box is needed. One of the most ubiquitous activities in every day life is the delivery and retrieval of the daily mail. Most individuals look forward to receiving their daily mail, often eagerly awaiting the arrival of the mail postal person. In rural areas, the mailbox often stands along the roadway, adjacent the homeowner's property. The mailbox is usually fitted with a flag to indicate to the postal person that there are posted letters inside the box. The flag is raised above the box when the homeowner deposits the posted mail for pick-up. Upon retrieving the posted letters the postal person pushes the flag back to its neutral, horizontal position. This indicates to the homeowner that the posted letters have been taken from the box and that newly arrived mail may be present.

However, on those occasions where the mail recipient has no letters to post, the arrival of the daily mail is non-indicated. Unless the property owner actually catches the exact moment of arrival of the postal person, there is absolutely no way to determine that new mail has arrived. Additionally, on the days in which the postal person does not have mail to deliver, the property owner is not notified unless he actually glimpses the actions of the postal person.

Thus, it may be seen that these prior art patents are very limited in their teaching and utilization, and an improved mail indication system is needed to overcome these limitations.

SUMMARY OF THE INVENTION

The invention features a mailbox indicator for determining when the daily mail postal person has deposited mail in a rural or suburban mailbox. The mailbox indicator features a weighted flag, which is attached to the mailbox door in proximity to the door hinge. The flag is placed so it will be held by the closed mailbox door against the mailbox, to a free dangling position upon the unlatching of a mailbox door. Visual presence of the dangling, brightly colored flag indicates that the daily mail has been delivered.

It is an object of the present invention to provide an improved mail indicator.

It is a further object of this invention to provide a mail indicator that is easy to use.

It is a further object of this invention to provide a mail indictor which is easily reset.

It is an object of this invention to provide a mail indicator that will not interfere with the mail postal person.

It is an object of this invention to provide a mail indicator that works in conjunction with the actions of the mail postal person.

Further, it is an object of this invention to provide a mail indicator that will maintain the weather integrity of the mailbox.

It is an object of this invention to provide a mail indicator which is completely weather proof.

It is another object of this invention to provide a mail indicator that has minimal moving or working parts.

It is a further object of the present invention to provide a mail indicator that is easy to install without tools.

It is a further object of the present invention to provide a mail indicator that is low in cost.

It is a further object of this invention to provide a mail indicator that is mechanically reliable.

It is a further object of this invention to provide a mail indication system which may be installed upon a user-determined area of the mailbox to allow a user to determine the best visibility position available for the signal flag.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
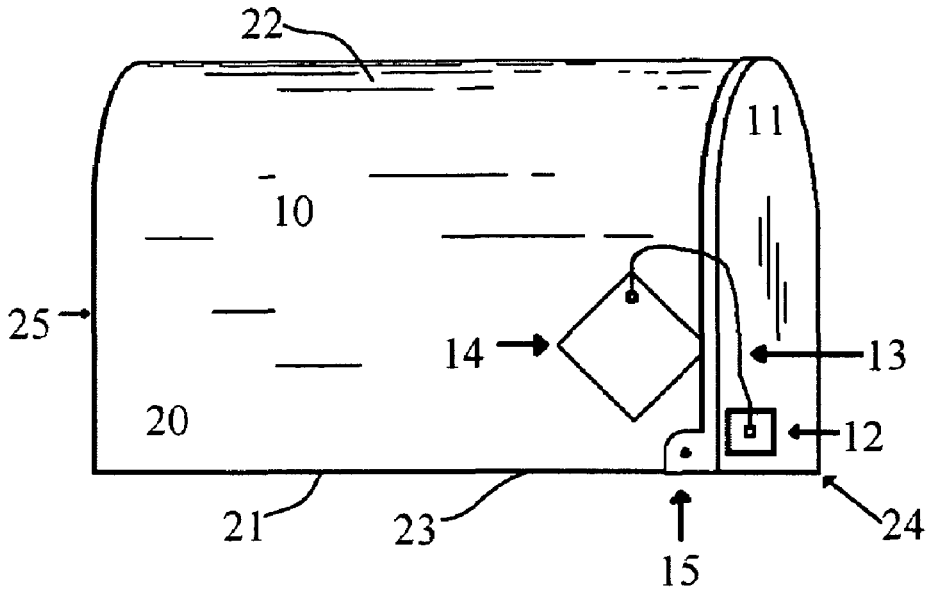
FIG. 1 is a left isometric view of my improved mail indications system deployed within a mailbox in accordance with the present invention.

Generally speaking, the invention is directed to a mail indicating device 15 for determining whether the daily mail has arrived. The mail indicating device 15 includes a signal indicator 14, an attachment assembly 12, and a linking tether 13 connecting the signal indicator 14 to the attachment assembly 12. The signal indicator 14 is held wedged against the mailbox 10 and the movable opening 11 of the mailbox. Opening of the movable opening 11 for delivery of mail causes the signal indicator 14 to drop to an observable position below the mailbox, thus indicating that mail has been delivered. Upon retrieval of mail, the indicating device 15 is reset.

Now referring to FIG. 1, the mail indicating device 15 is shown in a first operative position with the signal indicator 14 held against the mailbox 10. The mailbox 10 as shown includes an exterior shell 20 having a bottom 21, a curved top side 22 extending from the left side 23 of the bottom 21 to the right side 24 of the bottom, a movable opening 11, and a back wall 25. The movable opening 11 of the mailbox 10 is embodied in FIG. 1 as the mailbox door. As shown, the attachment assembly 12 is mounted upon the movable opening 11 of the mailbox. In this manner, the movement of the movable opening 11 motivates the wedged signal indicator, thus repositioning the signal indicator 14 linked to the attachment assembly 12.

Figure 2:
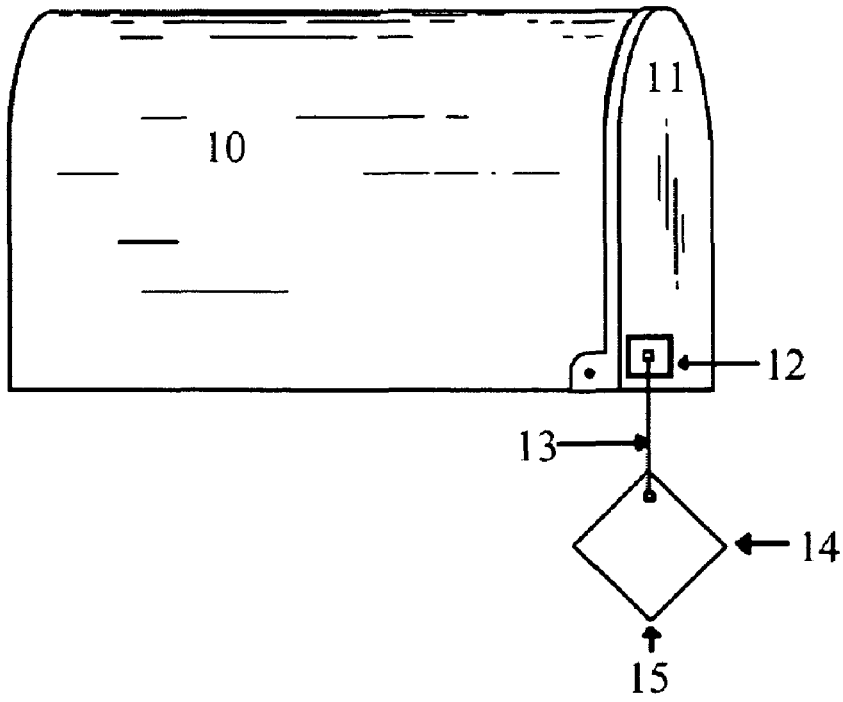
FIG. 2 is a left isometric view of the same deployed outside a mailbox in accordance with the present invention.

Referring to FIG. 2, the mail indicating device 15 is illustrated in a second operative position. The movable opening 11, having been opened for deposit of mail, has released the signal indicator 14, which drops below the mailbox 10, and hangs by the linking tether 13.

Figure 3:
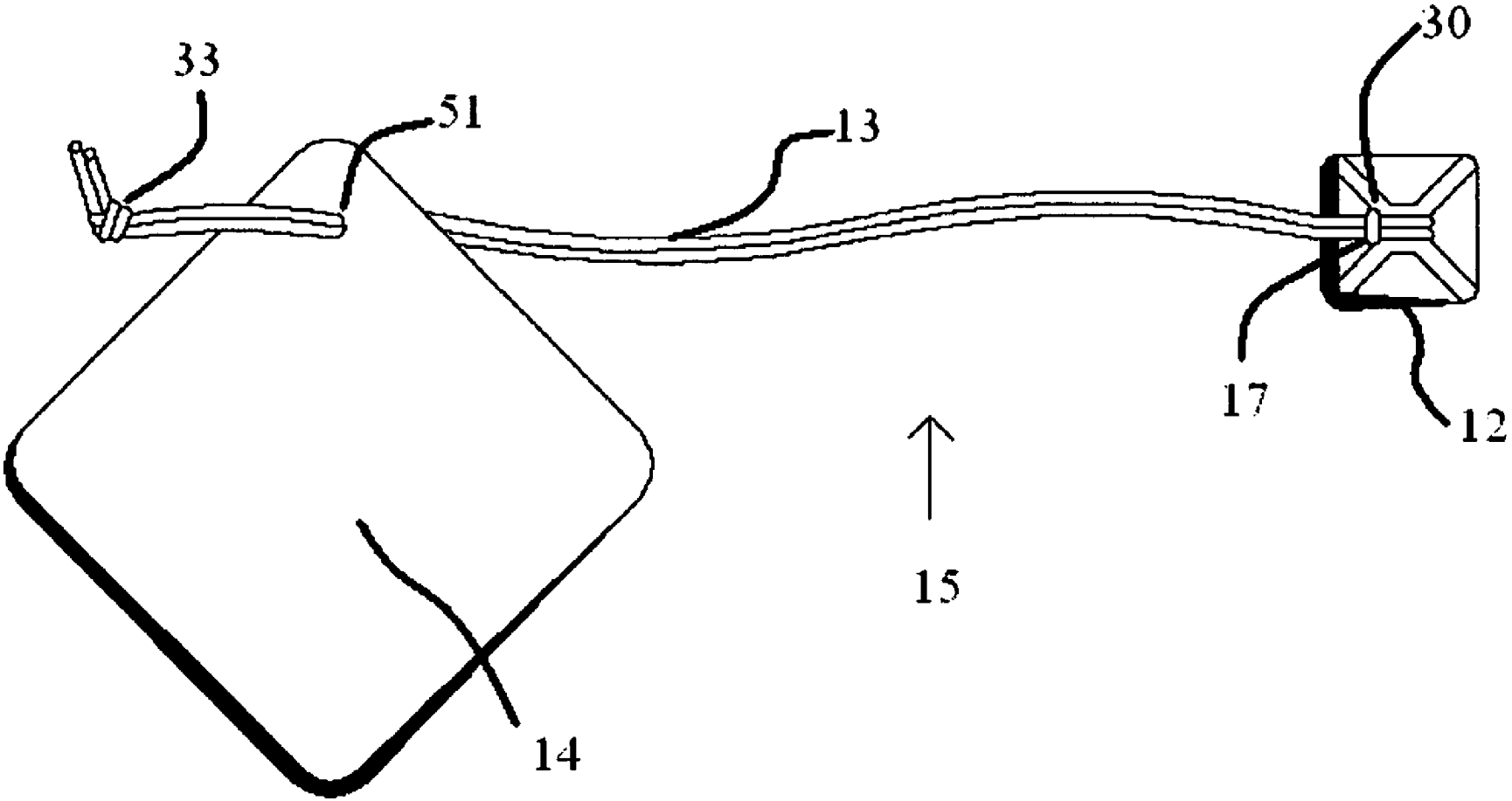
FIG. 3 is a top plan view of my improved mail indication system.
Figure 4:
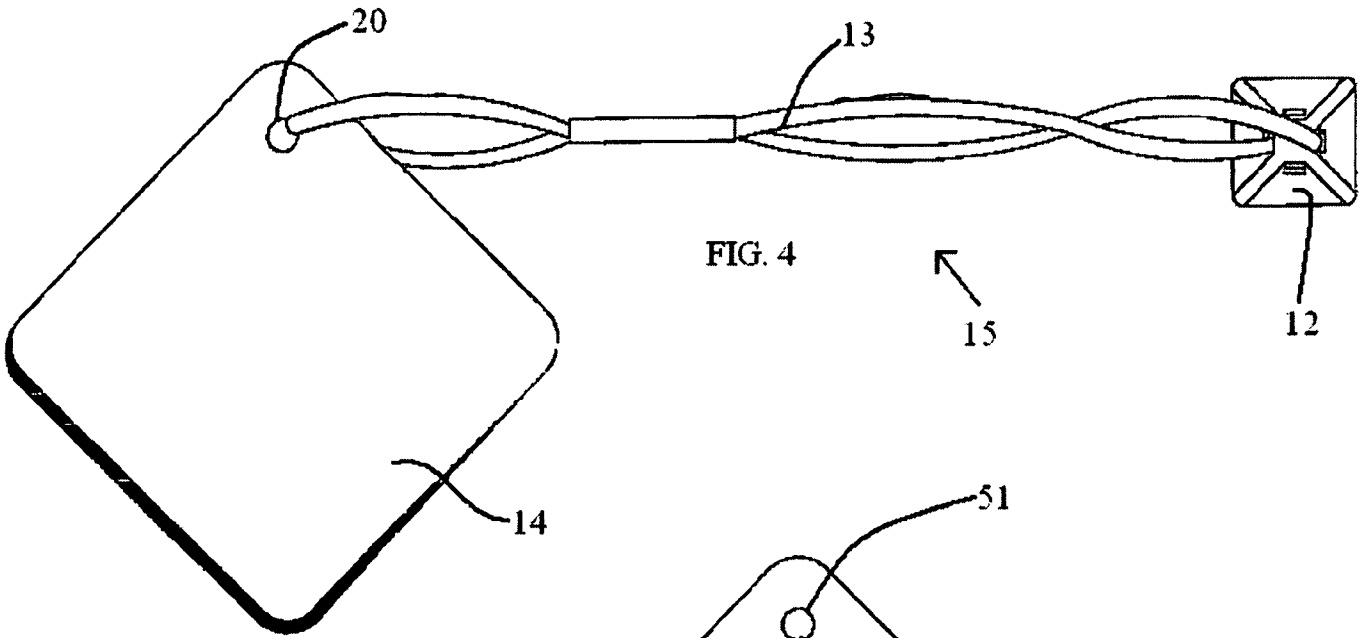
FIG. 4 is a top plan view of another embodiment of my improved mail indication system.

FIG. 3 and FIG. 4 illustrate two embodiments of the present invention, each having a different configuration of the linking tether 13 for its attachment to the attachment assembly 12 and the signal indicator 14. As shown in FIG. 3, the linking tether 13 may utilize a slip knot 30 for the connection to the attachment assembly 12 and utilize an overhand knot 33 proximate to the signal indicator 14. As shown in FIG. 4, the linking tether 13 may loop around a portion of the attachment assembly 12 for the connection to the attachment assembly 12 and loop through a portion of the signal indicator 14.

The linking tether 13 as shown is adapted to secure the attachment assembly 12 and the signal indicator 14. In the preferred embodiment, the linking tether is composed of a weather-resistant synthetic polymer, such as a plastic or nylon. The linking tether 13 must withstand deformation from repeated use and weather exposure to maintain the integrity of the invention. Additionally, the tether 13 must be durable to withstand the actions of deployment of the device, such as the closing of the movable opening 11 on the tether 13. Further, the linking tether 13 must be sufficiently pliant to allow for repeated repositioning of the mail indication device against the mailbox 10. The attachment assembly 12 is self-adhesive; in this manner, users who may have difficulty grasping objects may be attach the indicating device 15 with a minimum of difficulty. The linking tether 13 must consist of an appropriate length of material to allow for the proper positioning of the signal indicator 14 when deployed. The signal indicator 14 must be positioned distally from the mailbox 10 so as to allow an observer to see the signal indicator without obstruction by the mailbox 10. In a preferred embodiment, the signal tether would have a length between one and six inches. However, some users may find that a longer tether 13 positions the signal indicator 14 in a more appropriate position for viewing. This positioning may be to avoid shrubbery, landscape features, or other obstructive elements.

Figure 5:
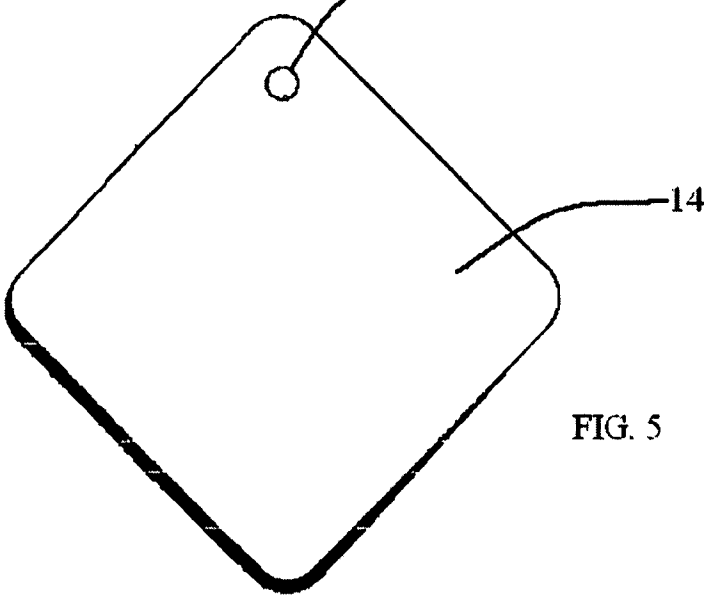
FIG. 5 is a top plan view of the signal indicator of my improved mail indication system, the top plan view being a mirror image of the bottom plan view.
Figure 6:
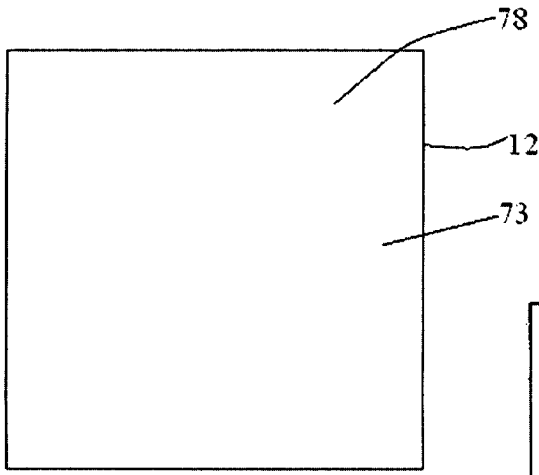
FIG. 6 is a bottom plan view of the attachment assembly of my improved mail indication system.
Figure 8:
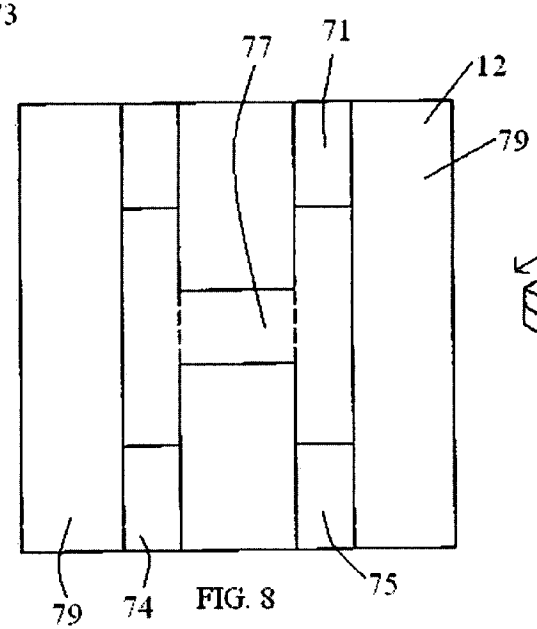
FIG. 8 is a top plan view of the same.
Figure 9:
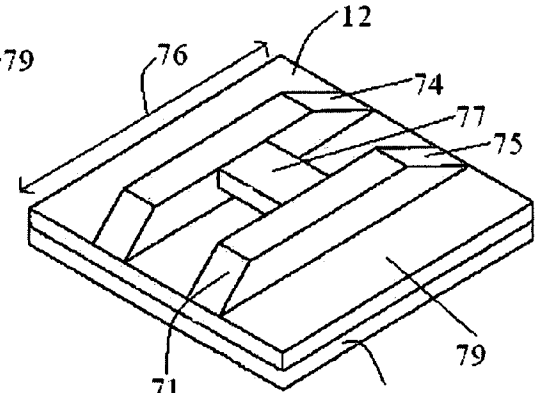
FIG. 9 is an isometric view of the same.
Figure 7:
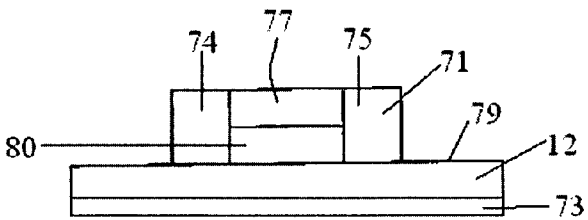
FIG. 7 is a left side elevational view of the same, the left side elevational view being a mirror image of the right side elevational view.
Figure 10:
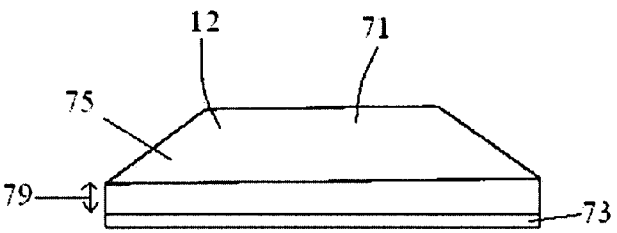
FIG. 10 is a front side elevational view of the same, the front side elevational view being a mirror image of the back side elevational view.

FIG. 5 illustrates the signal indicator 14 removed from the linking tether 13 and the attachment assembly 12. The signal indicator 14 has a tether recess 51 for securing the linking tether 13 to the signal indicator 14. The tether recess 51 may include a hole drilled through the signal indicator or other similar divots which would allow for the connection of the linking tether 13. The signal indicator is composed of a gravitationally dense non-metallic material, preferably a heavy plastic, to provide the signal indicator 14 with the weight necessary to fall beneath the mailbox 10 when the movable opening 11 is motivated. The dense non-metallic aspect of the signal indicator 14 is important to the invention for many reasons. Without the weight of the signal indicator 14, the signal indicator 14 may not fall beneath the mailbox 10 after the motivation of the movable opening 11. This would impair the functioning of the device and prevent a user from adequately recognizing mail delivery. Additionally, the dense non-metallic material of the signal indicator 14 prevents the signal indicator 14 from disruption caused by the elements. Many of the signal indicators shown in previous inventions have utilized light-weight metallic material which may be damaged by the elements or blown in the wind, causing the mail indication device to wrap around elements of the mailbox, surrounding plants, or other nearby items. The dense material of the present invention allows the signal indicator 14 to withstand many of these forces, thus providing a mail indication device which will not become tangled with nearby items. In a preferred embodiment, the signal indicator 14 is composed of a material having a density between 1.25 g/cc to 1.45 .g/cc. The density of the signal indicator 14 also motivates the signal indicator 14 to a downward position below the mailbox 10 when deployed. This positioning benefits the observer of the device as it deploys in a substantially consistent location below the mailbox 10 in contrast to other mail indication devices which deploy upwards creating confusion between the standard mail flag and the mail indication device. Further, the dense material helps the signal indicator 14 to withstand deformation from the weather and from repeated use. Mail indication devices are under a constant barrage of wind, water, and cold. The dense plastic material of the signal indicator 14 enables the device to withstand rust, wrinkling, and other shape-modifying afflictions.

The signal indicator 14 material may further be modified to provide a visual element such as a colorful indication to an observer. In some areas, certain colors may blend too closely with the surrounding environment. Therefore, there is a need to provide contrasting colors for the signal indicator 14 to allow an observer to appropriately judge whether the device has been deployed. Further, the signal indicator 14 may utilize other designs more visually pleasing to the user.

FIG. 7 through FIG. 10 show various views of the attachment assembly 12. The attachment assembly is generally composed of a tether anchor 71 and a securing element 72 for attachment to the mailbox 10. The securing element 72 is located upon the base 78 of the tether anchor 71. In another embodiment, the securing element 72 may run through the width 79 of the tether anchor 71. The securing element 72 may include a fastener or, as in the preferred embodiment, an adhesive pad 73. The adhesive pad 73 has the benefit of providing attachment to the mailbox 10 without the use of tools or without comprising the weather integrity of the mailbox. The tether anchor 71 as shown includes a face 79, two parallel extensions 74, 75 running along the length 76 of the attachment assembly, and a connection extension 77 connecting the two parallel extensions 74, 75. The connection extension 77 does not connect to the face 79 of the tether anchor 71; instead a void 80 is left below the connection extension 77 to allow for the linking tether to be threaded around the tether anchor 71.

The attachment assembly 12 is intended to be mounted on the movable opening 11 of the mailbox 10. In this manner, the attachment assembly 12 is motivated with the movable opening 11 when mail is delivered. The motivation of the attachment assembly 12 encourages the linking tether 13 connected to the tether anchor 71 to pull the signal indicator 14 from the wedged position against the mailbox 10. When the movable opening 11 is returned to a close position by the mail carrier, the signal indicator 14 remains in the second operative position. The indicating device 15 is reset to its first operating position upon collection of mail.

In describing a preferred embodiment of the invention illustrated in the drawings, specific terminology has been used for the sake of clarity. However, the invention is not intended to be limited to the specific terms selected, and it is to be understood that each specific term includes all technical equivalents which operate in a similar manner to accomplish a similar purpose.

What is claimed is:

1. In combination, a mail indication device and a postal mailbox having a movable door and an exterior, said mail indication device comprising:

an attachment assembly comprising a tether anchor and a securing element for mounting said attachment assembly to said movable door of said postal mailbox on an exterior of said movable door;

a linking tether adapted to secure to said attachment assembly, said linking tether composed of a weather-resistant material and adapted to withstand deformation; and a signal indicator having a tether recess adapted to secure said linking tether to said signal indicator, said signal indicator composed of a gravitationally dense material and having a flattened edge for placement between said movable door and said exterior of said postal mailbox, whereby opening movement of said movable door of said postal mailbox urges said linking tether to pull said signal indicator from between said movable door and said exterior of said postal mailbox and motivates said signal indictor to an observable position below said postal mailbox.

2. The combination of claim 1, said securing element being an adhesive pad.

3. The combination of claim 1, said tether anchor being composed of a weather-resistant material.

4. The combination of claim 1, said signal indicator material being composed of plastic.

5. The combination of claim 1, said signal indicator material having a density between 1.25 g/cc to 1.45 g/cc.

6. The combination of claim 1, said linking tether having a length adapted to deploy said signal indicator to said observable a position below said postal mailbox.

7. In combination, a mail indication device and a postal mailbox having a movable door and an exterior, said mail indication device comprising:

an attachment assembly comprising a tether anchor and a securing element for mounting said attachment assembly to said movable door of said postal mailbox on an exterior of said movable door;

a signal indicator having a tether recess and a flattened edge for placement between said movable door and said exterior of said postal mailbox, said signal indicator composed of a plastic material that is gravitationally dense and will withstand deformation;

a linking tether secured to said attachment assembly and said signal indicator to deploy said signal indicator to an observable position below said postal mailbox, said linking tether composed of a material that will withstand weather and deformation;

whereby opening movement of said movable door of said postal mailbox urges said linking tether to pull said signal indicator from between said movable door and said exterior of said postal mailbox and motivates said signal indictor to said observable position below said postal mailbox.

8. The combination of claim 7, said signal indicator material having a density between 1.25 g/cc to 1.45 g/cc.

9. The combination of claim 7, said tether anchor being composed of a weather-resistant material.

10. The combination of claim 7, said signal indicator material being composed of a weather-resistant material.

11. The combination of claim 7, said linking tether having a length between one and six inches.

12. A mail indication device for determining mail delivery status, said mail indication device comprising:

a postal mailbox comprising a movable door and an exterior shell defining an interior space of said postal mailbox;

an attachment assembly comprising a tether anchor and a securing element for mounting said attachment assembly to said movable door of said postal mailbox upon an exterior of said movable door;

a linking tether adapted to secure to said attachment assembly, said linking tether composed of a weather-resistant material and adapted to withstand deformation; and a signal indicator having a flattened edge for placement between said movable door and said exterior shell of said postal mailbox and a tether recess adapted to secure said linking tether to said signal indicator, said signal indicator composed of a gravitationally dense plastic material adapted to withstand deformation whereby opening movement of said movable door of said postal mailbox urges said linking tether to pull said signal indicator from between said movable door and said exterior shell of said postal mailbox and motivates said signal indictor to an observable position below said postal mailbox.

13. The device of claim 12, said tether anchor being composed of a weather-resistant material.

14. The device of claim 12, said signal indicator material being composed of a weather-resistant material.

15. The device of claim 12, said linking tether having a length adapted to deploy said signal indicator to said observable a position below said exterior of said postal mailbox.

16. The device of claim 15, said linking tether having a length between one and six inches.

17. The device of claim 12, said signal indicator having a visual element.

18. The device of claim 12, said signal indicator material have a density between 1.25 g/cc to 1.45 g/cc.

* * * * *